US010043622B1

(12) United States Patent
Park

(10) Patent No.: US 10,043,622 B1
(45) Date of Patent: Aug. 7, 2018

(54) GAS-INSULATED SWITCH GEAR USING DUAL MOTION WITH MULTI-LEVER

(71) Applicant: LSIS CO., LTD., Anyang-si, Gyeonggi-do (KR)

(72) Inventor: Jingun Park, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/475,054

(22) Filed: Mar. 30, 2017

(30) Foreign Application Priority Data

Jan. 25, 2017 (KR) ..... 10-2017-0012187

(51) Int. Cl.
*H01H 33/64* (2006.01)
*H01H 33/02* (2006.01)

(52) U.S. Cl.
CPC ..... *H01H 33/64* (2013.01); *H01H 33/02* (2013.01)

(58) Field of Classification Search
CPC ..... H01H 33/64; H01H 33/90; H01H 33/02; H01H 33/122; H01H 33/123; H01H 2033/02; H01H 2033/028; H01H 33/70; H01H 33/76
USPC ..... 218/154, 153, 12–14, 55, 57, 59, 61, 78, 218/84, 92, 97
See application file for complete search history.

(56) References Cited

U.S. PATENT DOCUMENTS 4,351,993 A * 9/1982 Graf ..... H01H 33/904 218/57
4,484,047 A * 11/1984 Olsen ..... H01H 33/245 218/84
6,342,685 B1 * 1/2002 Perret ..... H01H 33/904 218/78
8,013,268 B2 * 9/2011 Ozil ..... H01H 33/904 218/155
2008/0135526 A1 6/2008 Hunger
2010/0163527 A1 7/2010 Yoon
(Continued)

FOREIGN PATENT DOCUMENTS

CN 103518246 1/2014
JP 3808328 8/2006
KR 101566470 11/2005
(Continued)

OTHER PUBLICATIONS

Korean Intellectual Property Office Application No. 10-2017-0012187, Search report dated Sep. 12, 2016, 10 pages.
(Continued)

*Primary Examiner* — Renee Luebke
*Assistant Examiner* — William Bolton
(74) *Attorney, Agent, or Firm* — K&L Gates LLP

(57) ABSTRACT

The present disclosure may allow the movable base and the second movable contact driven in a dual-motion manner to be connected by a plurality of levers, and a force transferred to the movable base while the plurality of levers are in close contact with one another or released from the close contact may be transferred to the second movable contact, and thus a size of the levers may not be required to increase even when a stroke ratio between the movable base and the second movable contact increases, thereby having an effect capable of minimizing a size of the gas circuit breaker as well as appropriately controlling a stroke ratio between the movable base and the second movable contact.

8 Claims, 12 Drawing Sheets

(56) References Cited

U.S. PATENT DOCUMENTS

2015/0371797 A1* 12/2015 Cernat ..... H01H 33/7023
218/53

FOREIGN PATENT DOCUMENTS

| | | | | |
|---|---|---|---|---|
| KR | 100631007 | B1 | 9/2006 | |
| KR | 20090072579 | A | 7/2009 | |
| KR | 101024671 | | 3/2011 | |
| KR | 101045158 | | 6/2011 | |
| KR | 101115696 | | 3/2012 | |
| KR | 20130011700 | A | 1/2013 | |
| WO | WO2012155952 | A1 * | 11/2012 | ..... H01H 33/12 |

OTHER PUBLICATIONS

European Search Report for related European Application No. 17163717.6; report dated Sep. 29, 2017; (11 pages).

* cited by examiner

GAS-INSULATED SWITCH GEAR USING DUAL MOTION WITH MULTI-LEVER

CROSS-REFERENCE TO RELATED APPLICATIONS

Pursuant to 35 U.S.C. § 119(a), this application claims the benefit of earlier filing date and right of priority to Korean Patent Application No. 10-2017-0012187, filed on Jan. 25, 2017, the contents of which are all hereby incorporated by reference herein in its entirety.

BACKGROUND OF THE DISCLOSURE

1. Field of the Disclosure

The present disclosure relates to a dual-motion type gas-insulated switchgear having multiple levers, more particularly, to a dual-motion type gas-insulated switchgear having multiple levers capable of controlling an operation time for closing or opening as well as reducing a size of a gas circuit breaker as well as allowing to have a longer stroke.

2. Description of the Conventional Art

In recent years, electric power stations or the like have widely employed a gas-insulated switchgears (GIS) using sulfur hexafluoride (SF6) gas having a high insulation resistance among switch mechanisms constituting high voltage substation facilities.

Gas-Insulated Switchgear as an electric power device used for switching, grounding, branching and monitoring a high-voltage electric circuit in the range of several thousand to tens of thousands of volts in a power transmission, transformation and large distribution power system, is a switchgear that accommodates switching and grounding apparatuses in a tank filled with an insulating gas such as sulfur hexafluoride (SF6) for extinguishing an arc generated at the time of switching of a high-voltage line and electrical insulation between alternating current poles.

A gas circuit breaker provided in such a conventional gas-insulated switchgear may be divided into a movable portion and a stationary portion, wherein the movable portion is provided with a movable contact, a main nozzle and a cylinder, and the stationary portion is provided with a stationary contact brought into contact with or separated from the movable contact.

Here, a compression chamber may be provided within the cylinder, and an insulating gas is filled within the compression chamber. The gas circuit breaker is in a state that the movable contact and the stationary contact are in contact with each other at the time of closing, and in a state that the movable contact and the stationary contact are separated from each other at the time of opening.

In recent years, in order to improve the breaking performance of such a gas-insulated switchgear, a dual-motion type gas-insulated switchgear in which the stationary contact of the stationary portion relatively moves toward or away from the movable contact has been widely used.

On the other hand, FIG. 1 is a perspective view illustrating a dual-motion structure of a gas-insulated switchgear in the related art, and FIGS. 2 through 5 are conceptual views illustrating a driving process through a dual-motion structure.

Furthermore, FIG. 6 is a block diagram illustrating a gas-insulated switchgear with a fork type dual-motion mode in the related art, and FIG. 7 is a block diagram illustrating a gas-insulated switchgear with a lever type dual-motion mode in the related art.

As illustrated in FIG. 1, according to a dual-motion structure in the related art, the movable base 11 may be connected to a second movable contact 19 with a plurality of levers 13, 15, 17 to move the second movable contact 19 according to the movement of the movable base 11 so as to allow the second movable contact 19 to be brought into contact with or separated from a first movable contact (not shown) provided on a first movable portion (not shown).

In other words, as illustrated in FIGS. 2 to 5, when the movable base 11 is moved to a breaking position by a drive device, a plurality of levers 13, 15, 17 rotate, and finally the second movable contact 19 may be separated from the first movable contact provided on the first movable portion while being moved backward according to the movement of the levers 13, 15, 17.

However, in case of such a dual-motion structure, when a stroke ratio between the movable base 11 and the second movable contact increases, a size of the levers 13, 15, 17 connecting the movable base 11 to the second movable contact 19 should be increased, thereby causing a problem of increasing a size of the gas circuit breaker provided in the gas-insulated switchgear.

Furthermore, as illustrated in FIG. 6, a dual-motion type gas-insulated switchgear formed with a fork type lever in the related art may include a first movable portion 21 provided with a first movable contact 21*a* and a nozzle 21*b* located on the left side, and a second movable portion 31 provided with a second movable contact 31*b* located on the right side.

Here, the second movable portion 31 is provided with a movable base 31*a*, and the movable base 31*a* is connected to the second movable contact 31*b* provided on the second movable portion 31 through a fork-shaped lever 31*c*.

Furthermore, the protrusion 31*a*-1 is formed on the movable base 31*a*, and when the movable base 31*a* moves, a fork-shaped protruding portion 31*c*-1 of the lever 31*c* rotates while being engaged with the protrusion 31*a*-1, and moves the second movable contact 31*b* at the same time to control the second movable contact 31*b* to be brought into contact with or separated from the first movable contact 21*a*.

However, in case of a fork-type gas-insulated switchgear, a strong impact may be incurred between the protrusion 31*a*-1 and the protruding portion 31*c*-1 of the lever 31*c* when the movable base 31*a* moves, thereby causing a problem in which a collision portion is easily broken when used for a long period of time.

On the other hand, as illustrated in FIG. 7, even in case of a gas-insulated switchgear with a lever type dual-motion mode, when a stroke ratio between a movable base 51 to a second movable contact 53 is set to 1:1, 1:2, 1:3 or the like, it may be adjusted only through the length of a lever 55, and therefore, when a stroke ratio between the movable base 51 and the second movable contact 53 connected to the lever 55 is relatively increased, a size of the lever should be increased, thereby causing a problem in which a size of gas circuit breaker is increased as a whole.

Furthermore, since the second movable contact 53 should move without a predetermined delay time when the movable base 51 moves, it may be impossible to move the second movable contact 53 only when a closing or opening operation is required, thereby causing a problem not to distribute energy used for closing or opening, thereby causing a problem significantly reducing the energy efficiency as well as deteriorating the opening performance.

SUMMARY OF THE DISCLOSURE

The present disclosure is contrived to solve the foregoing problems, and an object of the present disclosure is to provide a dual-motion type gas-insulated switchgear having multiple levers capable of controlling an operation time for closing or opening as well as reducing a size of a gas circuit breaker as well as allowing to have a longer stroke.

The foregoing object of the present disclosure may be accomplished by providing a dual-motion type gas-insulated switchgear having multiple levers including a first movable portion provided with a first movable contact and a second movable portion provided with a second movable contact to be brought into contact with or separated from the first movable contact, wherein the second movable portion includes a movable base connected to a drive device; a first lever one end of which is connected to the movable base to move in connection with the movable base; a second lever one end of which is connected to the other end of the first lever to move the first lever along with the movable base by a predetermined distance and then rotate; and a third lever one end of which is connected to the other end of the second lever, and the other end of which is connected to the second movable contact to move according to the rotation of the second lever to allow the second movable contact to be brought into contact with or separated from the first movable contact.

Furthermore, when the movable base is moved to an open state, the first lever may move while pulling one end of the second lever toward the movable base to rotate the second lever in a counter-clockwise direction, and in connection therewith, the other end of the second lever may move the other end of the third lever to be in close contact with a side of the second lever while pushing one end of the third lever toward an opposite side of the movable base to allow the second movable contact to be separated from the first movable contact.

Furthermore, when the movable base is moved to a closed state, the first lever may move while pushing one end of the second lever to an opposite side of the movable base to rotate the second lever in a clockwise direction, and in connection therewith, the other end of the second lever may move the other end of the third lever to be away from the second lever while pushing one end of the third lever toward the movable base to allow the second movable contact to be brought into contact with the first movable contact.

Furthermore, the second lever may rotate in a state of being fixed to the second movable portion through a stationary member.

Furthermore, the second lever may include a first connecting plate connected to the first lever, and formed to be inclined to an opposite side of the movable base; and a second connecting plate integrally formed with the first connecting plate to be connected to the third lever, and formed to be inclined to an opposite side of the movable base.

Furthermore, when the movable base is located in a closed state, a connecting portion between the first lever and the movable base may be located closer to the first movable contact than one end of the second lever, and when the movable base is moved from a closed position to an open position, the second lever may move the first lever along with the movable base by a predetermined distance and then rotate.

Furthermore, a mounting groove may be formed on a lower surface of the first connecting plate such that the other end of the third lever is brought into contact with the second lever and mounted thereon when in close contact with a side of the second lever.

Furthermore, the first connecting plate may be formed to be longer than the second connecting plate.

Furthermore, the third lever may be formed to be rounded toward the second lever.

As described above, in a dual-motion type gas-insulated switchgear with multiple levers according to the present disclosure, the movable base and the second movable contact driven in a dual-motion manner may be connected by a plurality of levers, and a force transferred to the movable base while the plurality of levers are in close contact with one another or released from the close contact may be transferred to the second movable contact, and thus a size of the levers may not be required to increase even when a stroke ratio between the movable base and the second movable contact increases, thereby having an effect capable of minimizing a size of the gas circuit breaker as well as appropriately controlling a stroke ratio between the movable base and the second movable contact.

Furthermore, the movable base and the second movable contact driven in a dual-motion manner may be connected by a plurality of levers, and when controlling the switchgear to a closed state or open state, the second movable contact may not be allowed to move at an initial or completed position even if the movable base moves, and the second movable contact may be allowed to move at a position other than the initial or completed position so as to brought into contact with or separated from the first movable contact, thereby having an effect of saving energy used during the closing or closing operation of the gas circuit breaker as well as enhancing the breaking performance of the gas circuit breaker.

Furthermore, the first connecting plate and the second connecting plate may be inclined to an opposite side of the movable base, and the first connecting plate may be formed to be longer than the second connecting plate to increase an amount of rotation when the second lever rotates through the first lever so as to increase a movement distance of the third lever connected to the lever, thereby having an effect of increasing a length of stroke applied to the second movable contact even in a small space.

Furthermore, the mounting groove may be formed on a lower surface of the first connecting plate such that the other end of the third lever is brought into contact with the mounting groove to be mounted thereon when in close contact with a side of the second lever, thereby having an effect of preventing a collision portion from being damaged by an impact between the second lever and the third lever when they are in close contact with each other.

Furthermore, the third lever may be formed to be rounded toward the second lever such that a rounded surface of the third lever is brought into contact with a surface of the second lever when the third lever is moved toward the second lever, thereby having an effect of minimizing collision with the second lever as well as increasing a length of stroke applied to the second movable contact.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION OF THE DISCLOSURE

Hereinafter, a dual-motion type gas-insulated switchgear with multiple levers according to an embodiment of the present disclosure will be described in detail with reference to the accompanying drawings.

Figure 1:
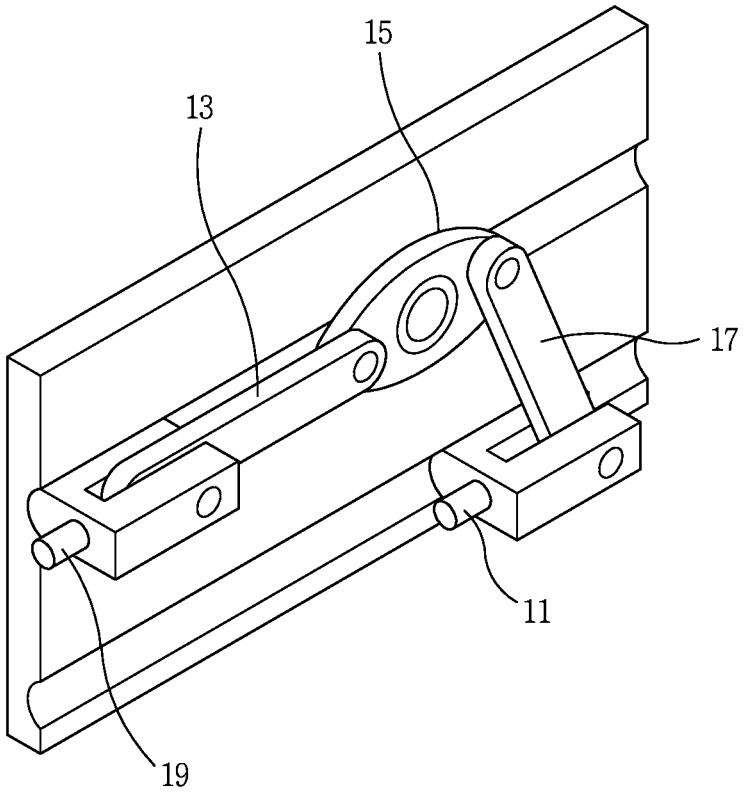
FIG. 1 RELATED ART
FIG. 1 is a perspective view illustrating a dual-motion structure of a gas-insulated switchgear in the related art.
Figure 2:
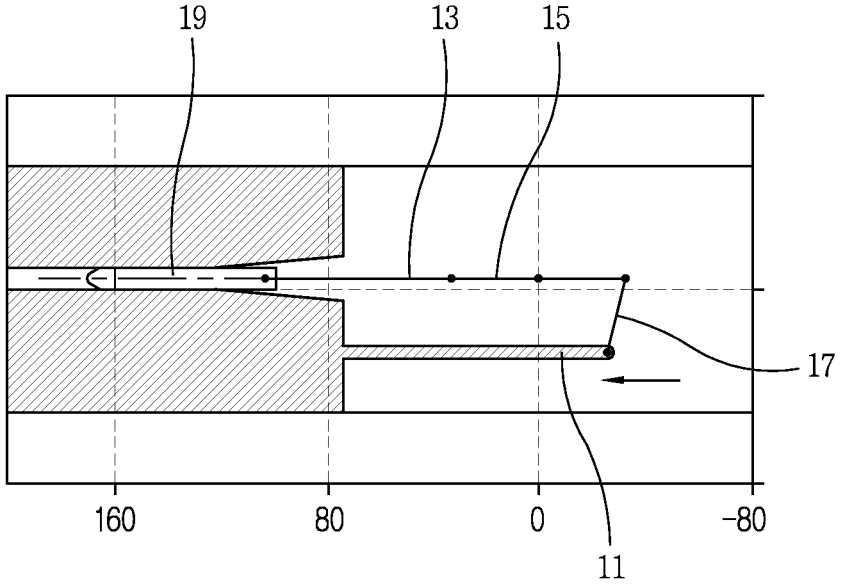
FIG. 2 RELATED ART
FIG. 2 is a conceptual view illustrating an operation process of a movable base and a second movable contact through a dual-motion structure provided in a gas-insulated switchgear in the related art.
Figure 3:
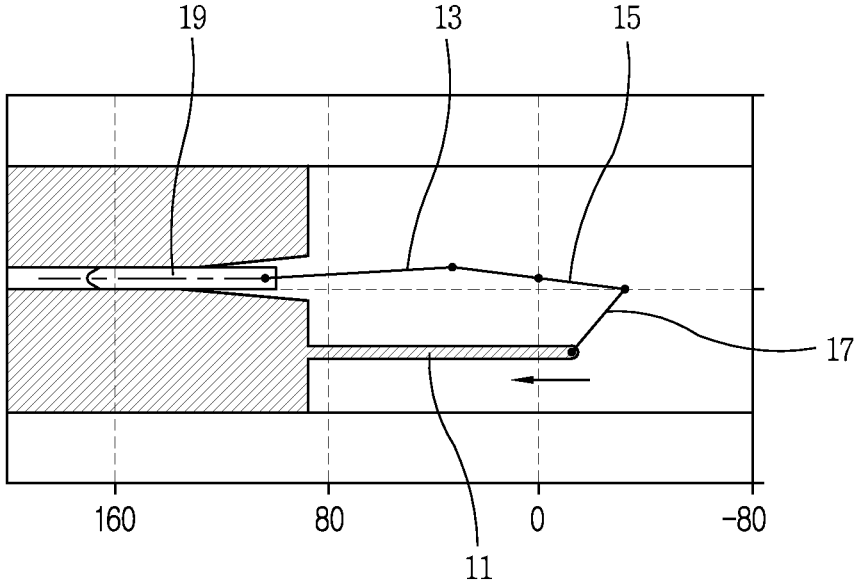
FIG. 3 RELATED ART
FIG. 3 is a conceptual view illustrating a state in which a movable base is moved through a dual-motion structure provided in a gas-insulated switchgear in the related art.
Figure 4:
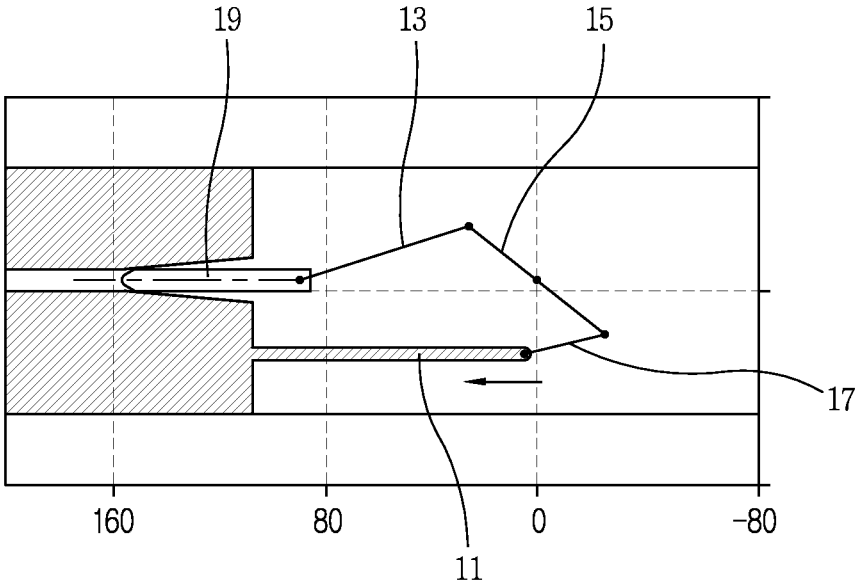
FIG. 4 RELATED ART
FIG. 4 is a conceptual view illustrating a state in which the movable base is further moved in FIG. 3 through a dual-motion structure provided in a gas-insulated switchgear in the related art.
Figure 5:
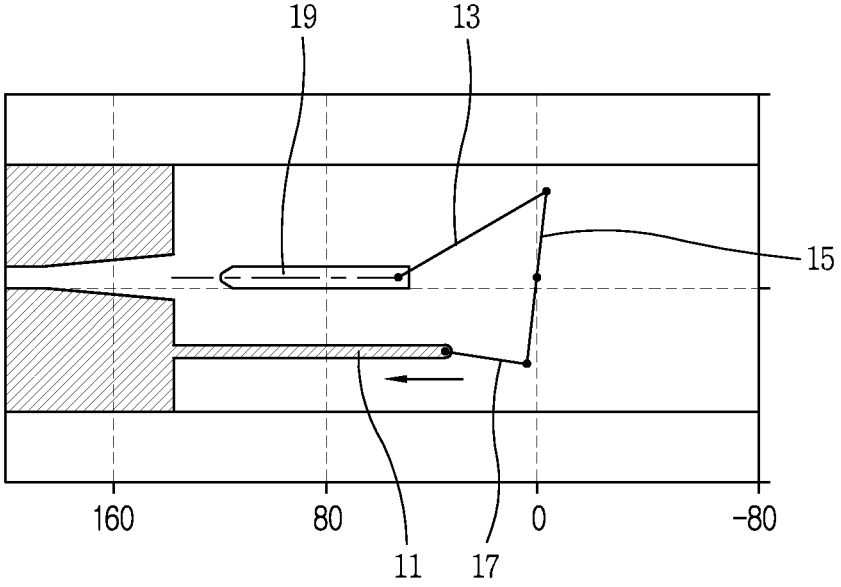
FIG. 5 RELATED ART
FIG. 5 is a conceptual view illustrating a state in which a movable base is moved through a dual-motion structure provided in a gas-insulated switchgear to separate a second movable contact from a first movable contact.
Figure 6:
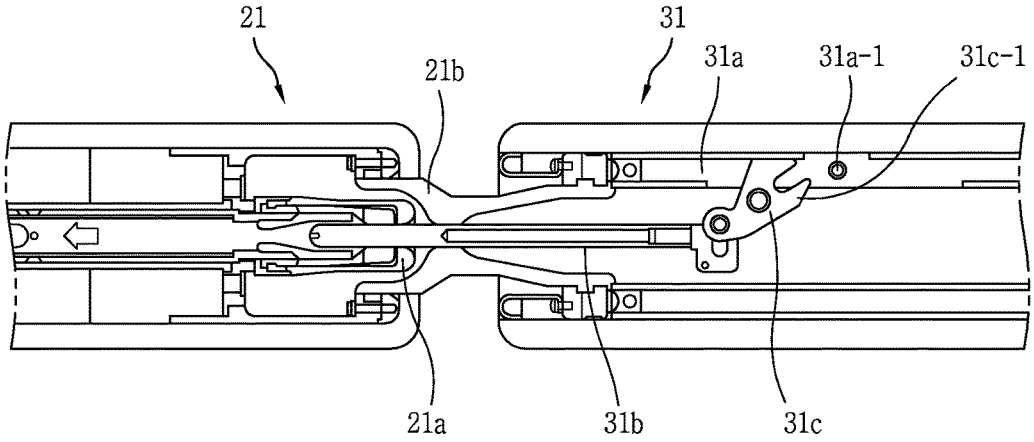
FIG. 6 RELATED ART
FIG. 6 is a configuration view illustrating a gas-insulated switchgear with a fork type dual-motion mode in the related art.
Figure 7:
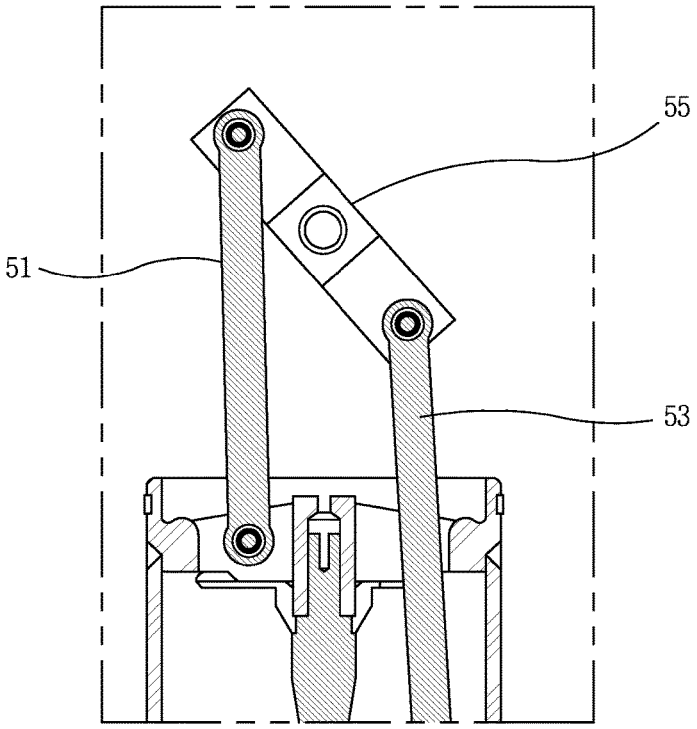
FIG. 7 RELATED ART
FIG. 7 is a configuration view illustrating a gas-insulated switchgear with a lever type dual-motion mode in the related art.
Figure 8:
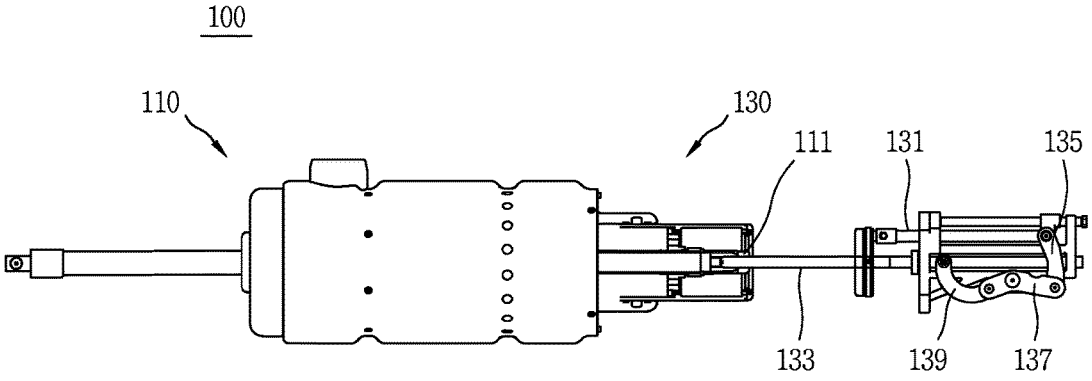
FIG. 8 is a configuration view illustrating a dual-motion type gas-insulated switchgear with multiple levers according to the present disclosure.
Figure 9:
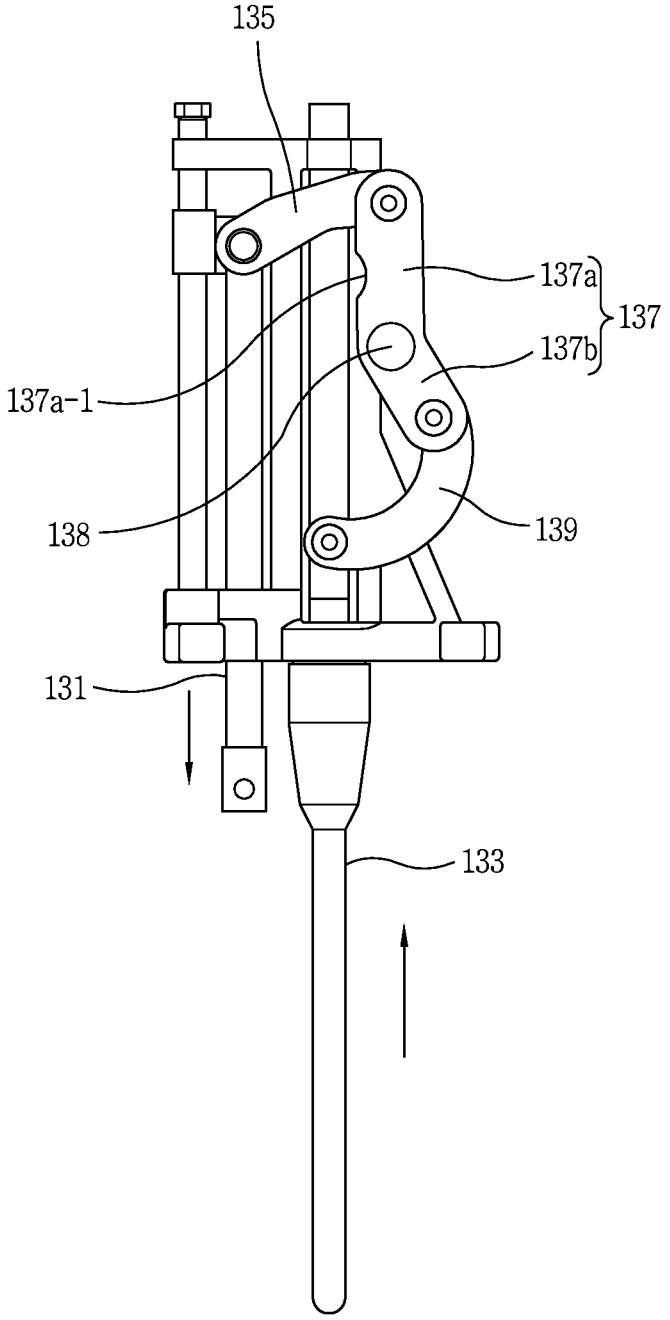
FIG. 9 is a configuration view illustrating a state in which a movable base of a dual-motion type gas-insulated switchgear having multiple levers according to the present disclosure starts to move from a closed state to an open state.
Figure 10:
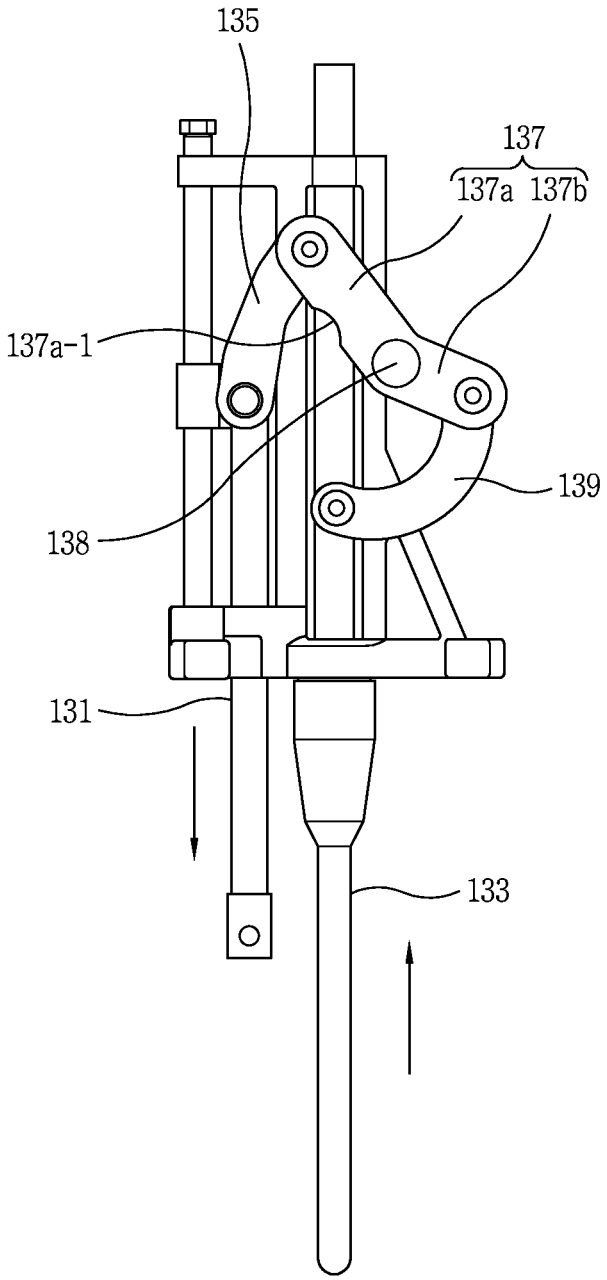
FIG. 10 is a configuration view illustrating a state in which a movable base of a dual-motion type gas-insulated switchgear having multiple levers according to the present disclosure has moved from a closed state to an open state by a predetermined distance.
Figure 11:
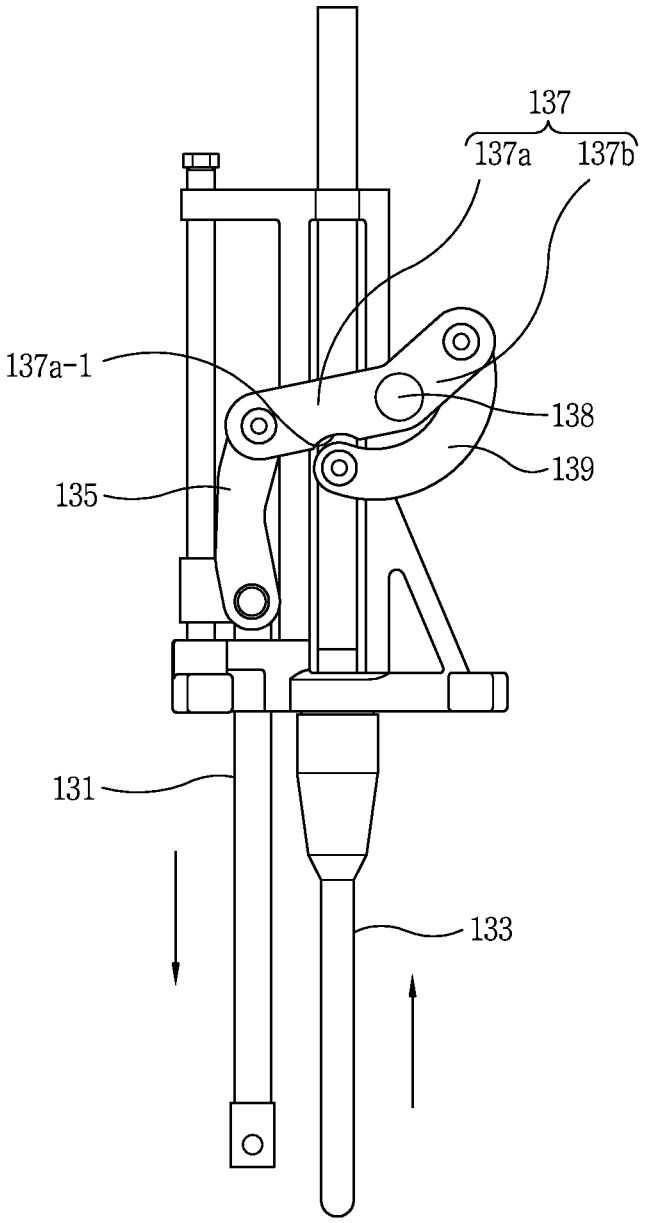
FIG. 11 is a configuration view illustrating a state in which a movable base of a dual-motion type gas-insulated switchgear having multiple levers according to the present disclosure has moved to an open state.
Figure 12:
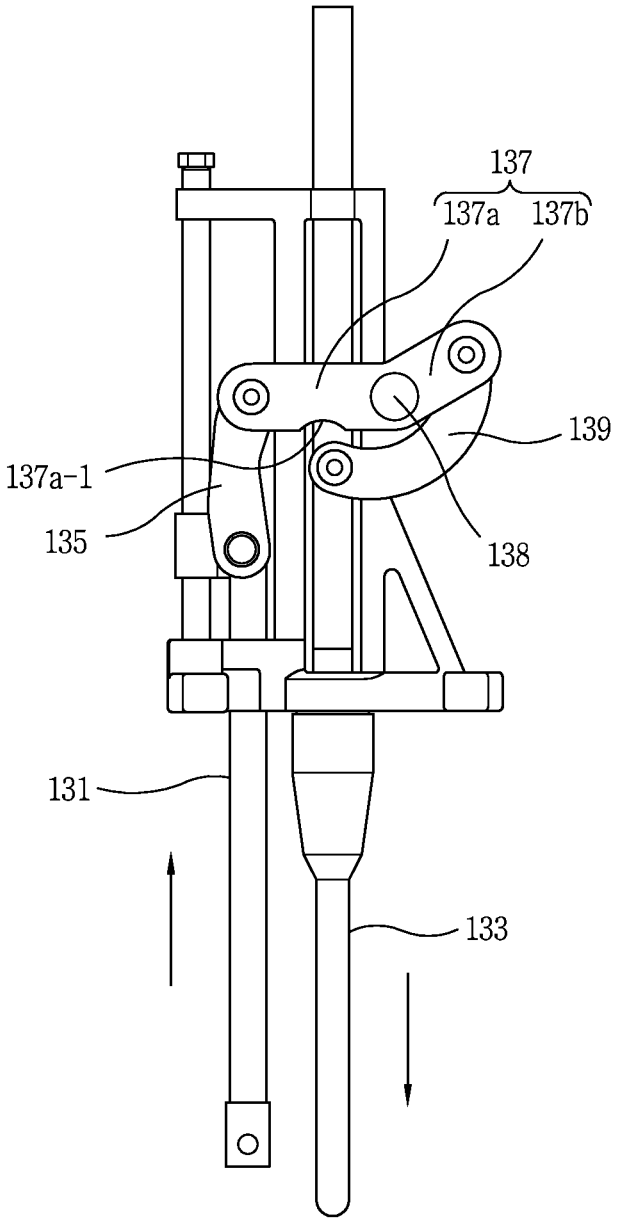
FIG. 12 is a configuration view illustrating a state in which a movable base of a dual-motion type gas-insulated switchgear having multiple levers according to the present disclosure starts to move from an open state to a closed state.
Figure 13:
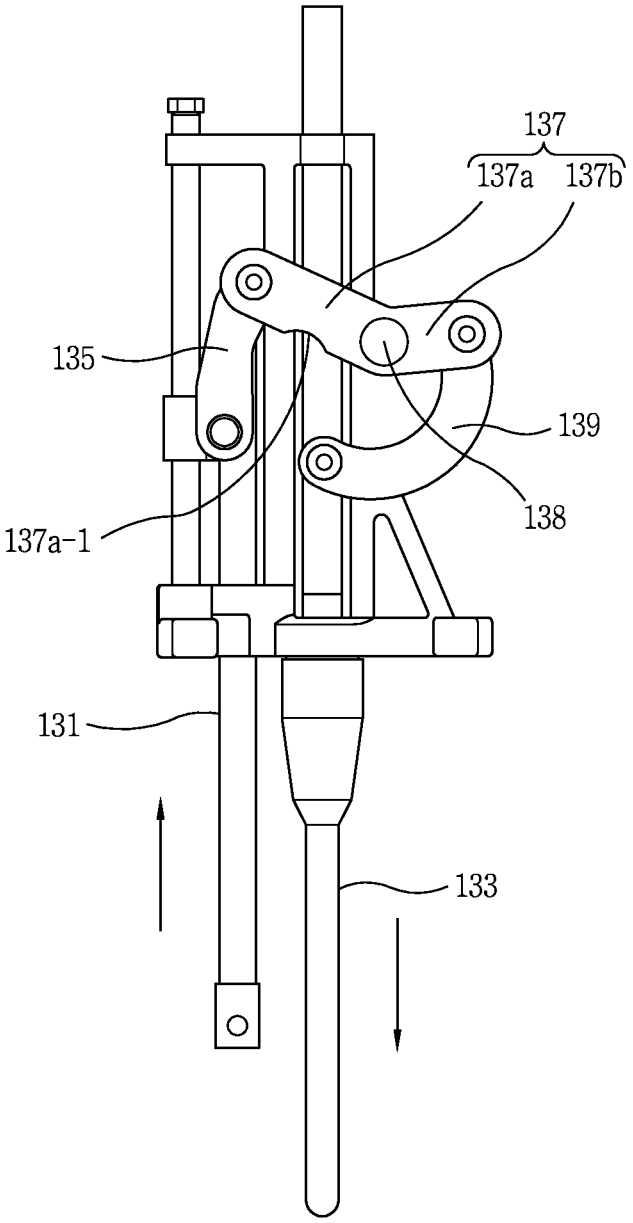
FIG. 13 is a configuration view illustrating a state in which a movable base of a dual-motion type gas-insulated switchgear having multiple levers according to the present disclosure has moved from an open state to a closed state by a predetermined distance.

FIG. 8 is a configuration view illustrating a dual-motion type gas-insulated switchgear with multiple levers according to the present disclosure, and FIG. 9 is a configuration view illustrating a state in which a movable base of a dual-motion type gas-insulated switchgear having multiple levers according to the present disclosure starts to move from a closed state to an open state, and FIG. 10 is a configuration view illustrating a state in which a movable base of a dual-motion type gas-insulated switchgear having multiple levers according to the present disclosure has moved from a closed state to an open state by a predetermined distance, and FIG. 11 is a configuration view illustrating a state in which a movable base of a dual-motion type gas-insulated switchgear having multiple levers according to the present disclosure has moved to an open state, and FIG. 12 is a configuration view illustrating a state in which a movable base of a dual-motion type gas-insulated switchgear having multiple levers according to the present disclosure starts to move from an open state to a closed state, and FIG. 13 is a configuration view illustrating a state in which a movable base of a dual-motion type gas-insulated switchgear having multiple levers according to the present disclosure has moved from an open state to a closed state by a predetermined distance.

Figure 14:
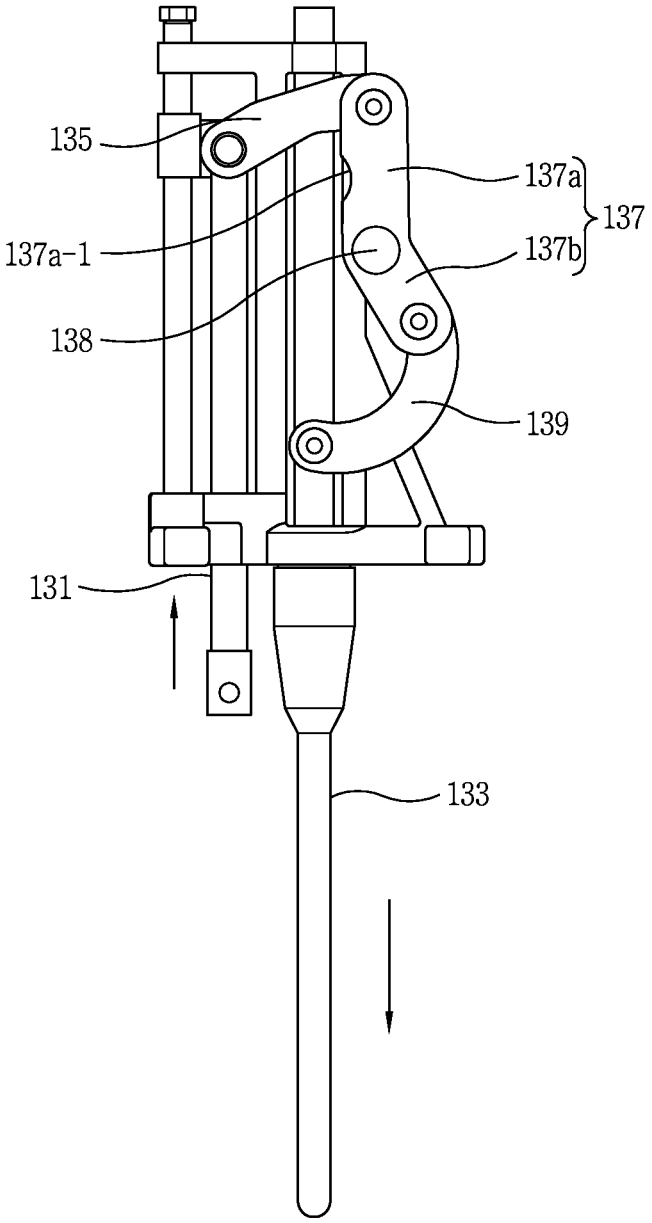
FIG. 14 is a configuration view illustrating a state in which a movable base of a dual-motion type gas-insulated switchgear having multiple levers according to the present disclosure has moved from an open state to a closed state.
Figure 15:
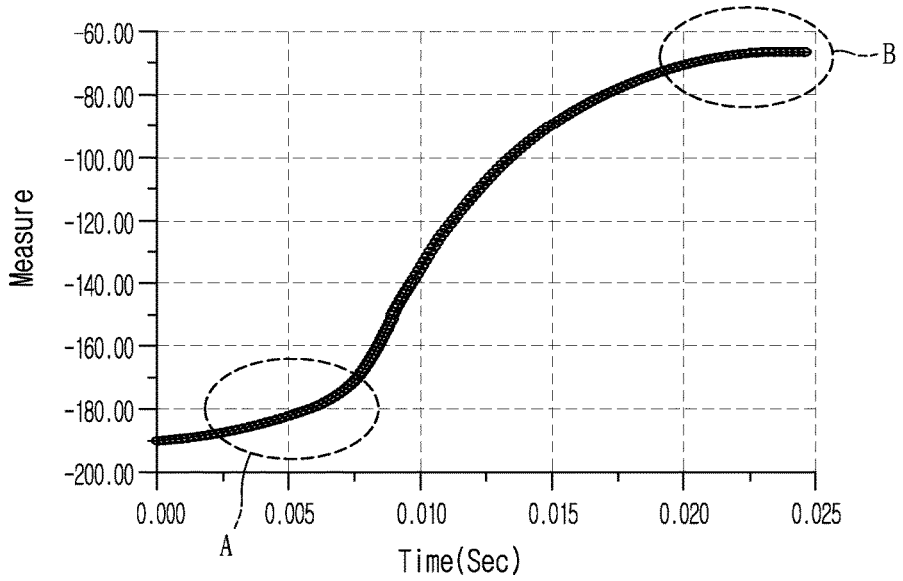
FIG. 15 is a graph illustrating a stroke change of a second movable contact when the movable base moves in dual-motion type gas-insulated switchgear with multiple levers according to the present disclosure.
Figure 16:
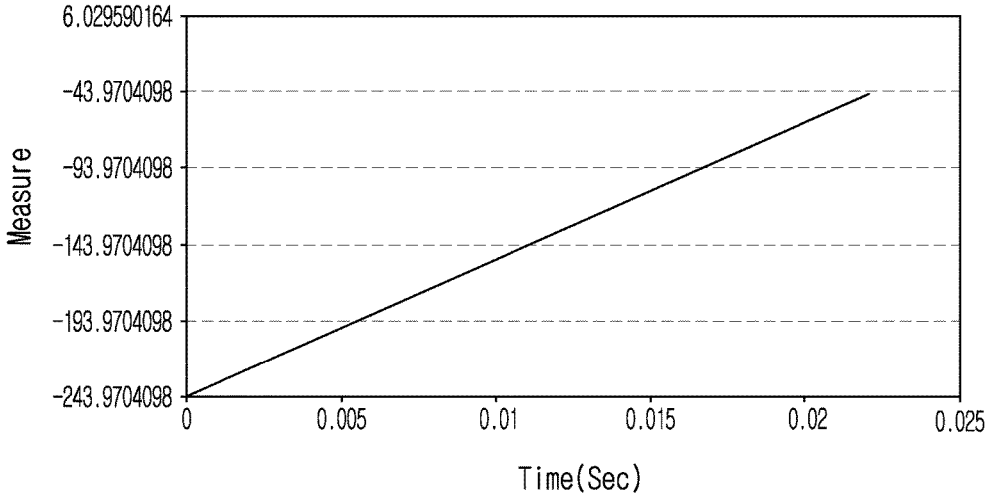
FIG. 16 is a graph illustrating a stroke change when the movable base moves in a dual-motion type gas-insulated switchgear having multiple levers according to the present disclosure.

FIG. 14 is a configuration view illustrating a state in which a movable base of a dual-motion type gas-insulated switchgear having multiple levers according to the present disclosure has moved from an open state to a closed state, and FIG. 15 is a graph illustrating a stroke change of a second movable contact when the movable base moves in dual-motion type gas-insulated switchgear with multiple levers according to the present disclosure, and FIG. 16 is a graph illustrating a stroke change when the movable base moves in a dual-motion type gas-insulated switchgear having multiple levers according to the present disclosure.

As illustrated in FIG. 8, a dual-motion type gas-insulated switchgear with multiple levers according to the present disclosure may include a first movable portion 110 and a second movable portion 130 driven in a mutually moving dual-motion manner, and a gas circuit breaker 100, and the like.

Here, the first movable portion 110 is provided with a first movable contact 111, and the second movable portion 130 is provided with a second movable contact 133 brought into contact with or separated from the first movable contact 111.

Furthermore, the second movable portion 130 is provided with a movable base 131, a first lever 135, a second lever 137 and a third lever 139 to drive the second movable contact 133 in a dual-motion manner.

The movable base 131 is connected to the first lever 135 to move the second movable contact 133 in a connected manner through the respective levers 135, 137, 139 while moving by a drive device, and thus the second movable contact 133 is brought into contact with or separated from the first movable contact 111, thereby controlling the gas-insulated switchgear to be closed or opened.

One end of the first lever 135 is connected to the movable base 131, and the other end thereof is connected to the second lever 137 to rotate the second lever 137 while moving according to the movement of the movable base 131.

One end of the second lever 137 is connected to the first lever 135, and the other end thereof is connected to the third lever 139 to rotate in a clockwise or counter-clockwise direction according to the movement of the first lever 135 so as to move the third lever 139 close to or away from the second lever 137, thereby allowing the second movable contact 133 to be brought into contact with or separated from the first movable contact 111.

One end of the third lever 139 is connected to the other end of the second lever 137, and the other end thereof is connected to the second movable contact 133 to rotate the second lever 137 in a clockwise or counter-clockwise direction so as to move in close contact with or away from the second lever 137, thereby allowing the second movable contact 133 to be brought into contact with or separated from the first movable contact 111.

More specifically, as illustrated in FIGS. 9 to 11, when the movable base 131 is moved to an open state through the drive device, the first lever 135 moves along with the movable base 131 by a predetermined distance, then pulls one end of the second lever 137 toward the movable base 131 to rotate the second lever 137 in a counter-clockwise direction, and in connection therewith, the other end of the second lever 137 moves the other end of the third lever 139 to be in close contact with a side of the second lever 137 while pushing one end of the third lever 139 toward an opposite side of the movable base 131 to allow the second movable contact 133 to be separated from the first movable contact 111.

Furthermore, as illustrated in FIGS. 12 to 14, when the movable base 131 is moved to a closed state through the drive device, the first lever 135 moves while pushing one end of the second lever 137 to an opposite side of the movable base 131 to rotate the second lever 137 in a clockwise direction, and in connection therewith, the other end of the second lever 137 moves the other end of the third lever 139 to be away from the second lever 137 while pushing one end of the third lever 139 toward the movable base 131 to allow the second movable contact 133 to be brought into contact with the first movable contact 111.

On the other hand, when the gas-insulated switchgear is controlled to a closed state or open state, as illustrated in FIG. 9, when the movable base 131 is located at a closed state, a connecting portion between the first lever 135 and the movable base 131 is positioned closer to a contact portion between the first movable contact 111 and the second movable contact 133 than one end of the second lever 137, and when the movable base 131 is moved from a closed position to an open position, the second lever 137 moves along with the first lever 135 by a predetermined distance from the movable base 131 and then rotates.

In other words, the second lever 137 may be allowed to have a predetermined operation delay time, at an initial position in which the movable base 131 starts to move or at a completed position in which the movement of the movable base 131 is completed, the second lever 137 does not rotate even if the movable base 131 moves and thus the second movable contact 133 does not move.

Accordingly, as illustrated in FIGS. 15 and 16, even when a stroke is constantly applied to the movable base 131 through the drive device, the second lever 137 does not rotate at the initial position (A) or completed position (B) not to move the second movable contact 133 due to a small amount of stroke applied to the second movable contact 133, and the second lever 137 rotates at a position other than the initial position or completed position, namely, a position that requires closing or opening to rotate the second lever 137 so as to move the second movable contact 133 through the third lever 139 connected to the second lever 137 such that energy used for controlling the closing or opening of the gas-insulated switchgear is used only at a position that requires closing or opening, thereby reducing the amount of energy as well as enhancing the opening performance of the gas-insulated switchgear.

Meanwhile, the second lever 137 may include a first connecting plate 137*a* and a second connecting plate 137*b*.

The first connecting plate 137*a* is connected to the first lever 135, and formed to be inclined to an opposite side of the movable base 131.

Furthermore, the second connecting plate 137*b* is integrally formed with the first connecting plate 137*a* and connected to the third lever 139 and formed to be inclined to an opposite side of the movable base 131.

Accordingly, since the respective connecting plates 137*a*, 137*b* of the second lever 137 are formed to be inclined toward an opposite side of the movable base 131, when the second lever 137 rotates through the first lever 135, an amount of rotation of the second lever 137 increases to increase a movement length of the third lever 139 through the rotation of the second lever 137 so as to increase a length of stroke applied to the second movable contact 133 even in a small space.

Moreover, the first connecting plate 137*a* is formed to be longer than the second connecting plate 137*b* to decrease a stroke length applied to the third lever 139 through the second lever 13, thereby increasing an opening speed of the gas circuit breaker 100.

In addition, a mounting groove 137*a*-1 is formed on a lower surface of the first connecting plate 137*a* such that the other end of the third lever 139 is brought into contact with the second lever 137 and mounted thereon when in close contact with a side of the second lever 137.

Accordingly, when the second lever 137 rotates and the third lever 139 moves toward the second lever 137 to be in close contact therewith, the other end of the third lever 139 is located to be mounted on the mounting groove 137*a*-1, thereby preventing damage due to collision between the second lever 137 and the third lever 139 as well as increasing a length of stroke applied to the second movable contact 133 even through a small space.

Moreover, the third lever 139 is formed to be rounded toward the second lever 137.

Accordingly, when the second lever 137 rotates and the third lever 139 moves toward the second lever 137, a rounded surface of the third lever 139 is brought into close contact with the second lever 137 to minimize collision between the second lever 137 and the third lever 139, thereby preventing damage due to collision.

Furthermore, compared to when the third lever 139 has a flat shape, when the third lever 139 is moved toward the second lever 137, a central portion of the second lever 137 to which the stationary member 138 is further moved toward the third lever 139 by a roundly bent width of the third lever 139 to increase a moving distance of the third lever 139, thereby increasing a length of stroke applied to the second moving contact 133 even in a small space.

Hereinafter, an operation process of a dual-motion type gas-insulated switchgear with multiple levers will be described in detail with reference to FIGS. 9 through 14.

First, as illustrated in FIG. 9, when the movable base 131 is moved to an open position to separate the second movable contact 133 and the first movable contact 111 from each other through a driving device connected to the movable base 131, the first lever 135 connected to the movable base 131 moves along with the movable base 131.

Here, when the first lever 135 moves along with the movable base 131, the second lever 137 does not move along with the first lever 135 but has a predetermined delay time, and then rotates in a counter-clockwise direction according to the movement of the first lever 135.

In other words, as illustrated in FIG. 10, when the first lever 135 moves along with the movable base 131 by a predetermined distance and then the first lever 135 pulls the second lever 137 downward, the second lever 135 rotates, and at this time, a central portion of the second lever 137 is located in a state of being fixed to the second movable portion 130 through the stationary member 138, and thus does not move along with the first lever 135 but rotates in a counter-clockwise direction.

Furthermore, as illustrated in FIG. 11, when the second lever 137 rotates in a counter-clockwise direction, one end of the third lever 139 connected to the other end of the second lever 137 moves to an opposite side of the movable base 131 while being pulled toward the second lever 137, and in connection therewith, the other end of the third lever 139 moves close to a side of the second lever 137 to separate the second movable contact 133 from the first movable contact 111, thereby allowing the gas circuit breaker 100 to be in an open state.

Here, when the other end of the third lever 139 is brought into close contact with or away from the second lever 137, they move on the same line along with the stationary member 138, thereby decreasing a movement range of each lever 135, 137, 139.

Furthermore, since the third lever 139 is rounded toward the second lever 137, it may be possible to prevent damage due to mutual collision as well as increase a length of stroke applied to the second movable contact 133 even when the third lever 139 moves toward the second lever 137.

In addition, since the mounting groove 137*a*-1 is formed on a lower surface of the first connecting plate 137*a* constituting the second lever 137, when the third lever 139 moves close to a side of the second lever 137, the other end of the third lever 139 is mounted on the mounting groove 137*a*-1 to prevent breakage due to collision between them.

On the other hand, as illustrated in FIGS. 12 to 14, when the movable base 131 is moved to a closed position through the drive device, the first lever 135 connected to the movable base 131 moves while pushing one end of the second lever 137 to an opposite side of the movable base 131 to rotate the second lever 137 in a clockwise direction. Here, when the other end of the second lever 137 rotates in a clockwise direction while pushing one end of the third lever 139 toward the movable base 131, the other end of the third lever 139 is accordingly moved in a direction of being away from the second lever 137, and in connection therewith, the second movable contact 133 connected to the third lever 139 is moved toward the first movable contact 111 to allow the first movable contact 111 and second movable contact 133 to be brought into contact with each other, thereby allowing the gas circuit breaker 100 of the gas-insulated switchgear to be in a closed state.

In case of the present disclosure having the foregoing configuration, the movable base 131 and the second movable contact 133 driven in a dual-motion manner may be connected by a plurality of levers 135, 137, 139, and a force transferred to the movable base 131 while the plurality of levers 135, 137, 139 are in close contact with one another or released from the close contact may be transferred to the second movable contact 133, and thus a size of the levers 135, 137, 139 may not be required to increase even when a stroke ratio between the movable base 131 and the second movable contact 133 increases, thereby reducing a size of the gas circuit breaker 100 as well as appropriately controlling a stroke ratio between the movable base 131 and the second movable contact 133.

Furthermore, the movable base 131 and the second movable contact 133 driven in a dual-motion manner may be connected by a plurality of levers 135, 137, 139, and when controlling the switchgear to a closed state or open state, the second movable contact 133 may not be allowed to move at an initial or completed position even if the movable base 131 moves, and the second movable contact 133 may be allowed to move at a position other than the initial or completed position so as to brought into contact with or separated from the first movable contact 111, thereby saving an amount of energy used during the closing or closing operation of the gas circuit breaker 100 as well as enhancing the breaking performance of the gas-insulated switchgear.

Furthermore, the first connecting plate 137*a* and the second connecting plate 137*b* may be inclined to an opposite side of the movable base 131, and an amount of rotation may be allowed to increase when the second lever 137 rotates through the first lever 135, thereby increasing a length of stroke applied to the second movable contact 133 even in a small space.

Furthermore, the first connecting plate 137*a* may be formed to be longer than the second connecting plate 137*b* to decrease a length of stroke applied to the third lever 139 through the second lever 137, thereby increasing an opening speed of the gas circuit breaker 100.

Furthermore, the mounting groove 137*a*-1 may be formed on a lower surface of the first connecting plate 137*a* such that the other end of the third lever 139 is brought into contact with the mounting groove 137*a*-1 to be mounted thereon when in close contact with a side of the second lever 137, thereby preventing a collision portion from being damaged by an impact between the second lever 137 and the third lever 139.

Furthermore, the third lever 139 may be formed to be rounded toward the second lever 137 such that a rounded surface thereof is brought into contact with a surface of the second lever 137 when the third lever 139 is moved toward the second lever 137, thereby minimizing collision with the second lever 137 as well as increasing a movement distance of the second movable contact 133.

Though a preferred embodiment of the present disclosure has been described in the above, it will be apparent to those skilled in the art that various alternatives, changes and equivalents can be used for the present disclosure and the above embodiment is modified in an appropriate manner and applied thereto in the same manner. Accordingly, the disclosure is not intended to limit the scope of the disclosure as defined by the limitation of the following claims.

What is claimed is:

1. A dual-motion type gas-insulated switchgear having multiple levers including a first movable portion provided with a first movable contact and a second movable portion provided with a second movable contact to be brought into contact with or separated from the first movable contact, wherein the second movable portion comprises:

a movable base connected to a drive device;

a first lever one end of which is connected to the movable base to move in connection with the movable base;

a second lever one end of which is connected to the other end of the first lever to move the first lever along with the movable base by a predetermined distance and then rotate; and a third lever one end of which is connected to the other end of the second lever, and the other end of which is connected to the second movable contact to move according to the rotation of the second lever to allow the second movable contact to be brought into contact with or separated from the first movable contact, wherein the second lever comprises:

a first connecting plate connected to the first lever, and formed to be inclined to an opposite side of the movable base; and a second connecting plate integrally formed with the first connecting plate to be connected to the third lever, and formed to be inclined to an opposite side of the movable base.

2. The dual-motion type gas-insulated switchgear having multiple levers of claim 1, wherein when the movable base is moved to an open state, the first lever moves while pulling one end of the second lever toward the movable base to rotate the second lever in a counter-clockwise direction, and in connection therewith, the other end of the second lever moves the other end of the third lever to be in close contact with a side of the second lever while pushing one end of the third lever toward an opposite side of the movable base to allow the second movable contact to be separated from the first movable contact.

3. The dual-motion type gas-insulated switchgear having multiple levers of claim 1, wherein when the movable base is moved to a closed state, the first lever moves while pushing one end of the second lever to an opposite side of the movable base to rotate the second lever in a clockwise direction, and in connection therewith, the other end of the second lever moves the other end of the third lever to be away from the second lever while pushing one end of the third lever toward the movable base to allow the second movable contact to be brought into contact with the first movable contact.

4. The dual-motion type gas-insulated switchgear having multiple levers of claim 1, wherein the second lever rotates in a state of being fixed to the second movable portion through a stationary member.

5. The dual-motion type gas-insulated switchgear having multiple levers of claim 1, wherein when the movable base is located in a closed state, a connecting portion between the first lever and the movable base is located closer to the first movable contact than one end of the second lever, and when the movable base is moved from a closed position to an open position, the second lever moves the first lever along with the movable base by a predetermined distance and then rotates.

6. The dual-motion type gas-insulated switchgear having multiple levers of claim 1, wherein a mounting groove is formed on a lower surface of the first connecting plate such that the other end of the third lever is brought into contact with the second lever and mounted thereon when in close contact with a side of the second lever.

7. The dual-motion type gas-insulated switchgear having multiple levers of claim 1, wherein the first connecting plate is formed to be longer than the second connecting plate.

8. The dual-motion type gas-insulated switchgear having multiple levers of claim 1, wherein the third lever is formed to be rounded toward the second lever.

* * * * *